US005561928A

United States Patent [19]

Baghsarian

[11] Patent Number: 5,561,928

[45] Date of Patent: Oct. 8, 1996

[54] COLLAPSIBLE GREETING DISPLAY DEVICE

[76] Inventor: Avedis Baghsarian, 220 E. 72nd St., Apt. 12E, New York, N.Y. 10021

[21] Appl. No.: 437,401

[22] Filed: May 9, 1995

Related U.S. Application Data

[63] Continuation of Ser. No. 187,108, Jan. 26, 1994, abandoned.

[51] Int. Cl.[6] ..... G09F 1/00

[52] U.S. Cl. ..... 40/124.1; 40/539; 428/194; D20/29

[58] Field of Search ..... 40/124.1, 539, 40/633, 665; 446/486, 488, 901; 283/117; 428/194; D20/23, 29, 32

[56] References Cited

U.S. PATENT DOCUMENTS 2,407,592 9/1946 Wathen ..... 40/124.1

3,537,194 11/1970 Engle ..... 428/194 X 4,884,826 12/1989 Slagsvol ..... 428/194 X

*Primary Examiner*—Brian K. Green

*Attorney, Agent, or Firm*—Howard C. Miskin

[57] ABSTRACT

A display greeting card device includes a pair of superimposed flexible elongate rectangular strips mutually rigidly stapled at one end and joined at their opposite ends by a separable hinge member defining pressure sensitive tape. By separating one leaf of the hinge member tape from the respective end of the hinge tape and inverting the strips and rejoining the free ends of the strips with the hinge member tape, the strips assume the shape of a heart.

12 Claims, 1 Drawing Sheet

COLLAPSIBLE GREETING DISPLAY DEVICE

This is a continuation of patent application Ser. No. 08/187,108, filed Jan. 26, 1994, now abandoned.

BACKGROUND OF THE INVENTION

The present invention relates to improvements in display devices and it relates particularly to an improved collapsible extendible greeting display device.

A common folded type of greeting card is in a lay flat condition when closed collapsed and when it is opened one or more display members are erected by the relative movement of the opposing card panels. This type of greeting card possesses numerous drawbacks and disadvantages. It is complex and difficult to produce, it is expensive and fragile and otherwise leaves much to be desired.

SUMMARY OF THE INVENTION

It is a principal object of the present invention to provide an improved display device.

Another object of the present invention is to provide an improved greeting card.

Still another object of the present invention is to provide an improved greeting card which may be alternatively adjusted to a lay flat condition facilitating its housing in a letter type envelope for mailing or to a three dimensional display.

A further object of the present invention is to provide an erectable collapsible greeting card which is particularly suitable for many holidays and occasions such as Valentines Day, engagement cards, birthday cards and the like.

Still a further object of the present invention is to provide a display device of the above nature characterized by its ruggedness, ease of operation, attractive appearance, low cost and high versatility and adaptability.

The above and other objects of the present invention will become apparent from a reading of the following description taken in conjunction with the accompanying drawing which illustrates a preferred embodiment thereof.

A display device in accordance with the present invention includes a pair of superimposed elongate flexible strips rigidly mutually joined along transverse borders at one end of the strips and a transversely extending hinge member releasably joining the other ends of the strips whereby by detaching the hinge member from one of the strips and inverting and rejoining the strips with the hinge member the strips are curved and together assume the shape of a heart.

The strips may be formed of a suitable plastic material such as a synthetic organic thermoplastic polymer, for example a polyolefin or vinyl plastic and may be a laminate with of a plastic layer and a thin woven or non-woven fibrous layer. The strips are preferably rectangular and coincide in their collapsed state and the hinge member is a pressure sensitive adhesive coated pliable tape such as a vinyl tape. The faces of the strips may be decorated and colored as desired.

The improved display device is simple, inexpensive, convenient to mail, and easy to operate, and is highly versatile and adaptable.

DESCRIPTION OF THE PREFERRED EMBODIMENT

Figure 1:
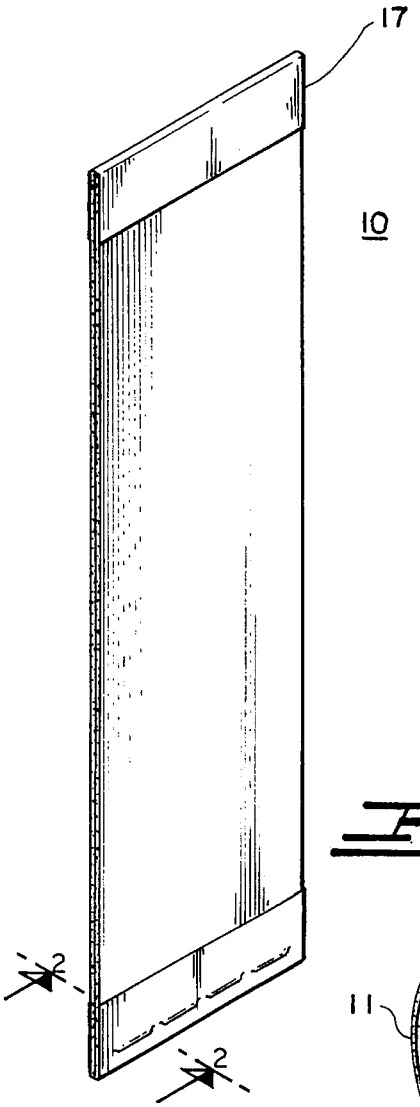
FIG. 1 is a front perspective view of a preferred embodiment of the present invention shown in a lay flat collapsed condition.
Figure 2:
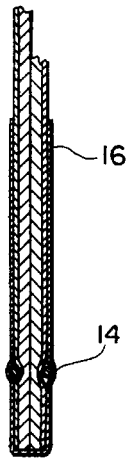
FIG. 2 is an enlarged fragmentary sectional view taken along line 2—2 in FIG. 1.
Figure 3:
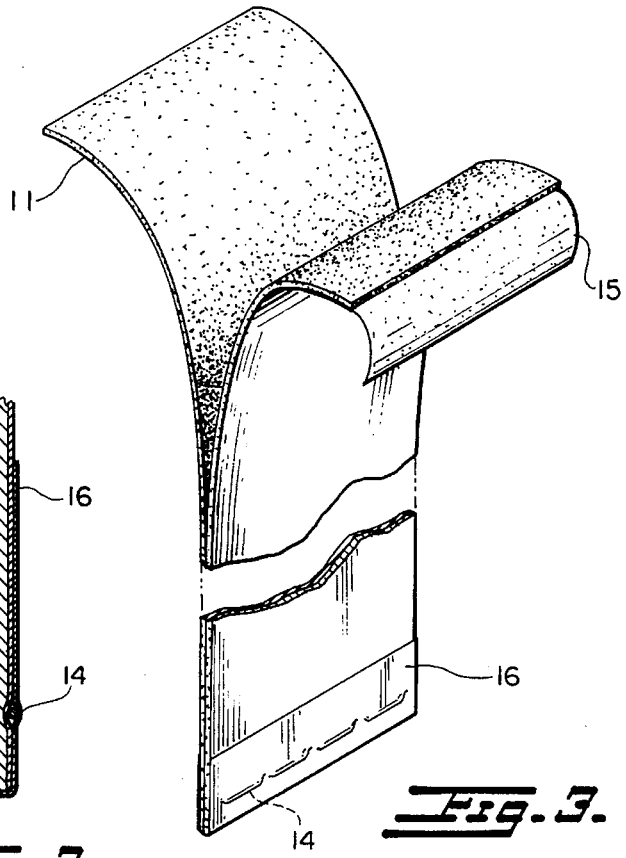
FIG. 3 is a front perspective view of the display device of FIG. 1 shown in a condition during the erection thereof.

Referring now to the drawings which illustrate a preferred embodiment of the present invention the reference numeral 10 generally designates the improved display device which includes a pair of similar rectangular flexible elongate strips or panels 11. Each strip 11 is a two-ply laminate including an outer normally flat highly flexible outer ply 12 formed of a synthetic organic thermoplastic polymeric resin, for example a suitable vinyl or polyolefin or other suitable plastic and a highly pliable inner ply 13 formed of a woven or non-woven fibrous web. The plies 12 and 13 may be of any desired colors may be decorated as desired, may carry suitable legends and may be receptive to marking with pen, pencil or the like.

In the collapsed condition of display device 10, the inner confronting faces thereof overlay and coincide with each other and the transverse borders of one end 16 of the superimposed strips 11 are firmly secured to each other by a line of transversely spaced staples, it being understood that these end borders may be otherwise rigidly mutually secured so as not to be relatively swingable. A strip of pressure sensitive tape 17 is transversely folded to sandwich the outer faces of the stapled end borders of strips 11 and are adherent to the outer faces of strips 11 and cover staples 14 at end 16.

A hinge member 17 is defined by a short length of highly pliable pressure sensitive tape 15 which embraces the transverse end borders of strips 11 opposite the stapled end borders thereof. The hinge member tape pressure sensitive adhesive coatings or faces separably adhere to the outside faces of the respective end orders of strips 11, the folded intermediate transverse section 18 of the adhesive tape defining a hinge element delineating opposite hinge leaves 19.

Figure 4:
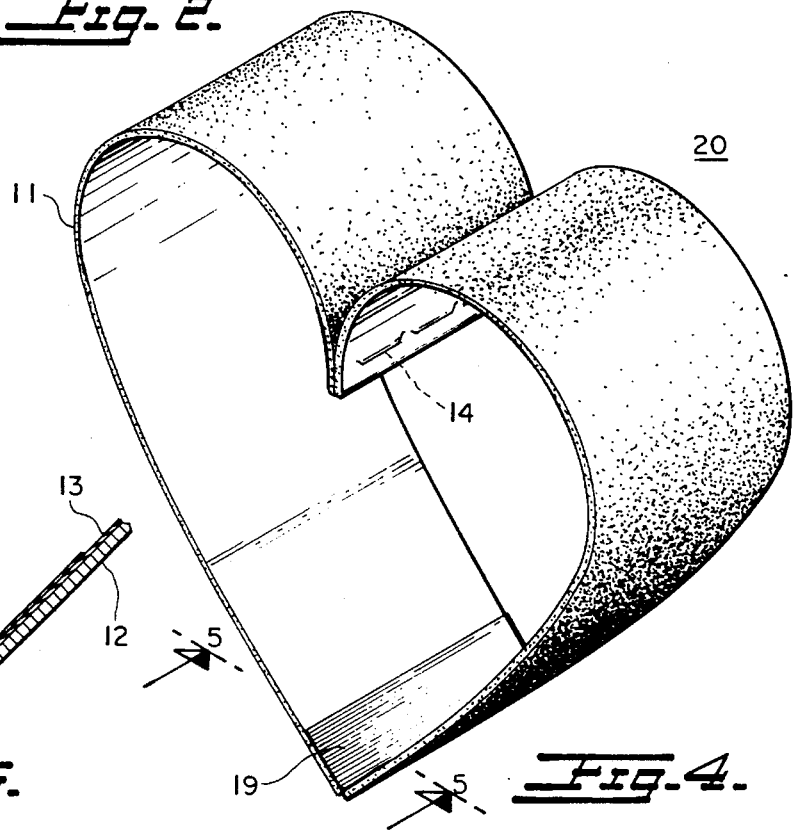
FIG. 4 is a front perspective view of the display device showing in its erected condition.
Figure 5:
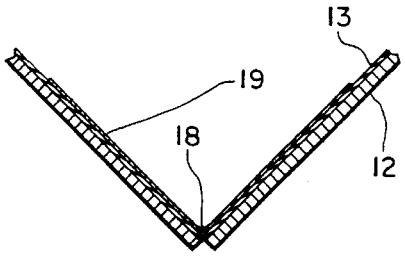
FIG. 5 is a sectional view taken along line 5—5 in FIG. 4.

To transform the flat collapsed device 10 as shown in FIG. 1 to the three dimensional condition in the shape of a heart 20 as shown in FIG. 4, one leaf of hinge tape 15 is separated or pulled from the end border of a respective strip 11 to relatively free the corresponding ends of strips 11. The strips 11 are then relatively outwardly curved and downwardly drawn to bring the free ends together below the rigidly joined opposite borders of strip 11. The free tape hinge leaf 19 is then applied to and adheres to the respective inside face of the unengaged border of the free end of strip 11 to hingedly join the end edges of strips 11 opposite the rigidly joined end borders thereof. The combined strips 11 in the aforesaid inverted condition respond to such inverted condition to assume the configuration of a heart as shown in FIG. 4.

The operation and manipulation of display device 10 as explained above are simple and convenient. In the collapsed condition of the device it may be easily mailed or stored and in its extended heart shaped condition it presents a highly attractive and meaningful appearance and message.

While there has been described and illustrated a preferred embodiment of the present invention it is apparent that numerous alterations, omissions, and additions may be made without departing from the spirit thereof.

I claim:

1. A display device comprising a pair of superimposed flexible strips having a pair of firmly mutually joined first ends and a hinge member for separably pivotably joining the second ends of said strips opposite said first ends, said strips having transverse end borders and said hinge member comprises a pliable web having a pressure sensitive adhesive face detachably engaging the transverse end borders of said strips at said second ends thereof, whereby said strips may be separated at said second ends and inverted about said first ends and rejoined at said second ends to assume a shape of a heart.

2. The display device of claim 1 including staples joining transverse borders of said strips at said first ends.

3. The display device of claim 2 including a pressure sensitive adhesive tape overlying said transverse borders and said staples.

4. The display device of claim 1 wherein each of said strips includes a flexible outer ply and an underlying pliable inner ply wherein said outer ply is formed of a synthetic organic thermoplastic polymer and said inner ply is formed of a fibrous web.

5. A display device to be readily assembled from a generally flat position to a heart shaped display comprising: a pair of superimposed flexible strips, each having a corresponding first end and a second end opposite said first end, each of said second ends having transverse end borders, means firmly joining said first ends, and a hinge member for separately pivotably joining said transverse end borders of said second ends when in assembled position, said strips being separable at said second ends and invertable about said joined first ends to bring said second ends into adjacent relationship, said second ends being joined by said hinge member to assume the shape of a heart.

6. The display device of claim 1 wherein each of said strips includes a flexible outer ply and an underlying pliable inner ply.

7. The display device of claim 6 wherein the inner ply has a decorative surface and the outer ply is receptive to writing.

8. The display device of claim 5 wherein the superimposed flexible strips are elongated.

9. The display device of claim 5 wherein the superimposed flexible strips are generally rectangular.

10. The display device of claim 5 wherein said first ends of said strips are fixedly joined together.

11. The display device of claim 5, wherein each of said second ends having inner facing transverse end surfaces when said strips are superimposed and outer transverse end surfaces, said transverse end borders of said second ends form inner and generally facing surfaces of the heart shaped display, said hinge member adheres to and holds the adjoining said transverse end border of said second ends.

12. The display device of claim 5 wherein said hinge member is a highly pliable pressure-sensitive tape.

* * * * *